US006142489A

United States Patent [19]

Borel

[11] Patent Number: 6,142,489

[45] Date of Patent: Nov. 7, 2000

[54] SUPPORT AND WEAR ELEMENT FOR AN IN-LINE ROLLER SKATE FRAME

[75] Inventor: Rene Borel, Saint-Sylvestre, France

[73] Assignee: Salomon S.A., Metz-Tessy, France

[21] Appl. No.: 09/196,244

[22] Filed: Nov. 20, 1998

[30] Foreign Application Priority Data

Nov. 26, 1997 [FR] France ..... 97 15122

[51] Int. Cl.[7] ..... A63C 17/06

[52] U.S. Cl. ..... 280/11.22; 280/809; 280/811

[58] Field of Search ..... 280/11.22, 11.23, 280/11.26, 11.27, 11.2, 11.19, 809, 811, 842, 11.28, 841

[56] References Cited

U.S. PATENT DOCUMENTS

| | | | |
|---|---|---|---|
| 3,993,318 | 11/1976 | Rothmayer | 280/11.26 |
| 4,932,675 | 6/1990 | Olson et al. | 280/7.13 |
| 5,385,356 | 1/1995 | Conte | 280/11.22 |
| 5,603,519 | 2/1997 | Conte | 280/11.22 |
| 5,630,624 | 5/1997 | Goodman | 280/809 |
| 5,762,346 | 6/1998 | Conte | 280/11.22 |
| 5,803,468 | 9/1998 | Petrrucci et al. | 280/11.2 |
| 5,806,860 | 9/1998 | Conte | 280/11.22 |
| 5,836,591 | 11/1998 | Roderick et al. | 280/11.22 |
| 5,890,723 | 4/1999 | Benoit | 280/11.22 |
| 5,934,692 | 8/1999 | Artus | 280/11.22 |
| 5,934,693 | 8/1999 | Nicoletti | 280/11.22 |
| 5,961,229 | 10/1999 | Post et al. | 280/7.13 |
| 5,967,552 | 10/1999 | Roderick et al. | 280/843 |

FOREIGN PATENT DOCUMENTS

| | | |
|---|---|---|
| 2188084 | 4/1997 | Canada . |
| 295 12 532 U | 11/1995 | Germany . |
| 296 13 508 U | 11/1996 | Germany . |
| 296 12 211 U | 12/1996 | Germany . |
| 19642887 | 4/1997 | Germany . |

*Primary Examiner*—Kenneth R. Rice
*Assistant Examiner*—Bridget Avery
*Attorney, Agent, or Firm*—Greenblum & Bernstein, P.L.C.

[57] ABSTRACT

A support and wear element for an in-line roller skate frame, adapted to be inserted between two lateral flanks of the frame and between two middle adjacent wheels, for practicing a so-called "aggressive" skating and, more specifically, for ensuring the transverse sliding of the skate on a longiline element, wherein the element has an arrangement for attachment on the frame which is constituted by vertical slide bars, facing each other on both sides of the internal surfaces of the flanks and cooperating with corresponding grooves obtained on the two lateral opposing surfaces of the support and wear element, such that its sliding mounting onto the flanks simultaneously ensures, on the one hand, its attachment and, on the other hand, the linkage of the flanks of the frame to one another in the transverse direction without secondary means, to constitute a single and coherent assembly with the frame.

6 Claims, 2 Drawing Sheets

SUPPORT AND WEAR ELEMENT FOR AN IN-LINE ROLLER SKATE FRAME

BACKGROUND OF THE INVENTION

1. Field of the Invention

The present invention relates to a frame and a support and wear element for an in-line roller skate frame adapted to be inserted between two lateral flanks of the frame and between two adjacent wheels, generally the middle; wheels, for practicing a so-called "aggressive" skating and, more specifically, for ensuring the transverse sliding of the skate on a longilinear element.

Such elements enable making figures or practicing sliding, for example, on stairway railings, rails, etc.

2. Description of Background and Material Information

Support and wear elements of the aforementioned type are known and are constituted of a block with a substantially parallelepipedical shape having, in the longitudinal direction, two surfaces in the form of a cylinder portion allowing for the passage of the adjacent wheels.

Such a wear element is known to be attached to the frame by means of a horizontal screw, transversely extending through both the lateral flanks of the frame and the element itself in order to integrate the assembly.

Furthermore, the wear element has, also as known, at its lower end, a substantially horizontal support surface aligned with the lower edges of the lateral flanges.

Even though the latter are also connected together by the axles of a plurality of in-line wheels, experiments prove nonetheless that the practice of such a sport in the aforementioned conditions causes progressive wear, not only of the wear element on its lateral edges in the transverse direction, but also of the lower edges of the lateral flanges. This has the long-term result of the support surface being reduced to a mere ridge.

This drawback was previously resolved by the Applicant who proposed a support and wear element equipped, on the side of its end adapted to serve as a support surface, with a longitudinal slot allowing to eliminate the central ridge due to wear and to still guarantee the presence of at least two lateral support surfaces.

However, usage has also revealed another problem in that the lower edges of the lateral flanges not only wear out but also tear away due to the violence of the impacts associated with this type of sport, since it is on these edges of the flanges that the angles are attacked in one direction or in the other.

This is easily understood in that the attachment of the support and wear element is obtained only by a horizontal screw extending transversely through the lateral flanges and the support element at a certain distance from the lower edges of these flanges.

One could have envisioned solving this problem by displacing this horizontal screw as far down as possible, so as to consolidate the linkage of the flanges near their lower edges, but it is easily understood that in that case, the margin for wear of the support element is notably limited, since the previously mentioned horizontal screw will be quickly reached.

SUMMARY OF THE INVENTION

An object of the present invention is to overcome the aforementioned drawbacks by proposing an improved slide and wear element, in the sense that it has means for attachment on the frame that are constituted of vertical slide bars facing one another on both sides of the internal surfaces of the flanks and cooperating with corresponding grooves made on two opposite lateral surfaces of the support and wear element, such that its sliding mounting onto the flanks simultaneously ensures, on the one hand, its linkage to the flanks and, on the other hand, the linkage of the flanks of the frame to one another in the transverse direction without secondary means, to constitute a single and coherent assembly with the frame.

BRIEF DESCRIPTION OF THE DRAWINGS

The present invention also relates to the features that will appear in the following description, and which must be considered separately or according to all their possible technical combinations.

This description, given by way of non-limiting example, will make it better understood how the invention can be embodied, with reference to the attached drawings in which.

DETAILED DESCRIPTION OF THE INVENTION

Figure 1:
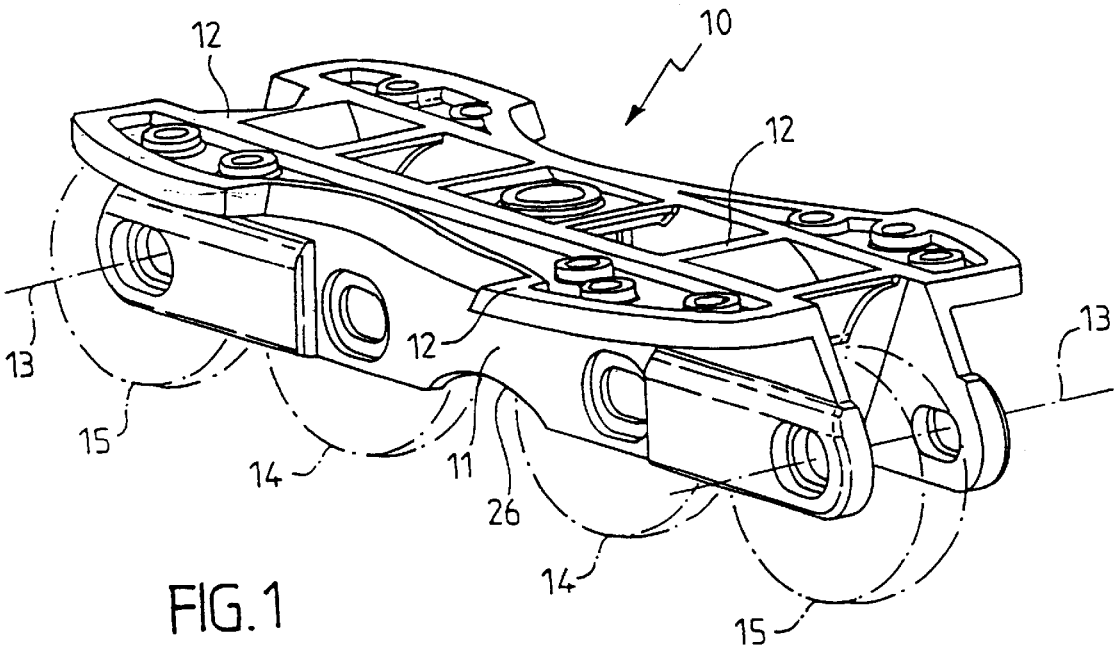
FIG. 1 is a perspective view of a frame adapted to receive at support and wear element according to the invention, before its mounting.
Figure 2:
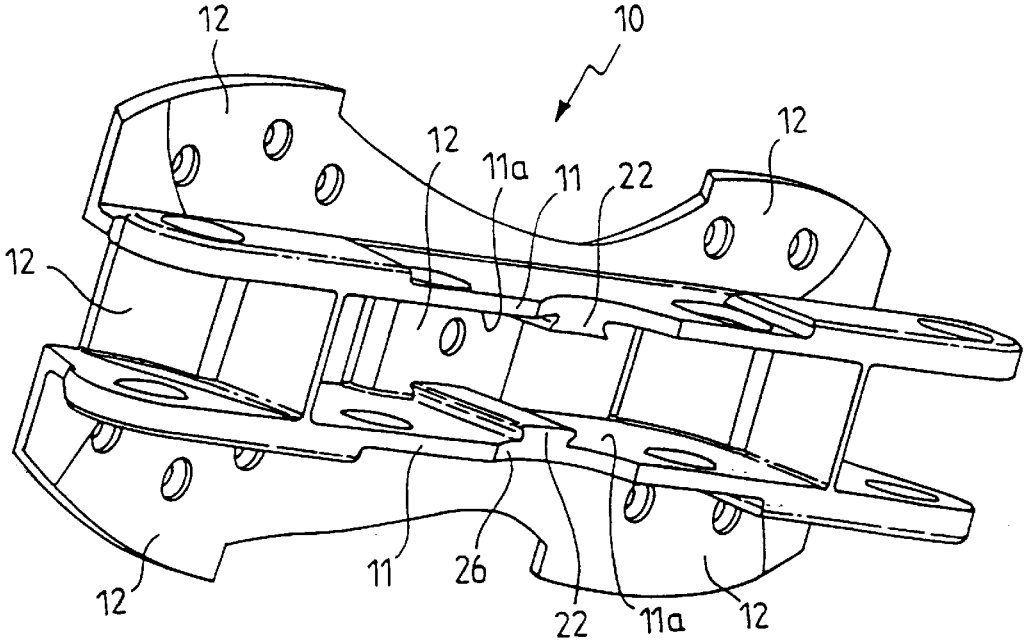
FIG. 2 is a bottom perspective view of a frame according to FIG. 1.
Figure 3:
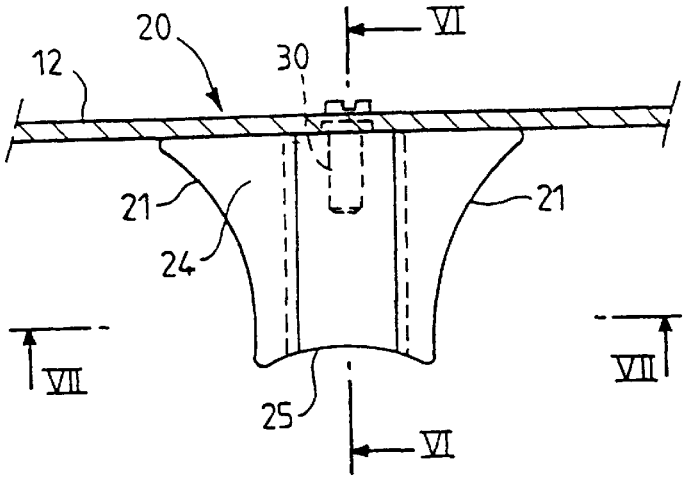
FIG. 3 is a side view of a support and wear element according to the invention, showing its linkage on a frame according to FIGS. 1 and 2.
Figure 4:
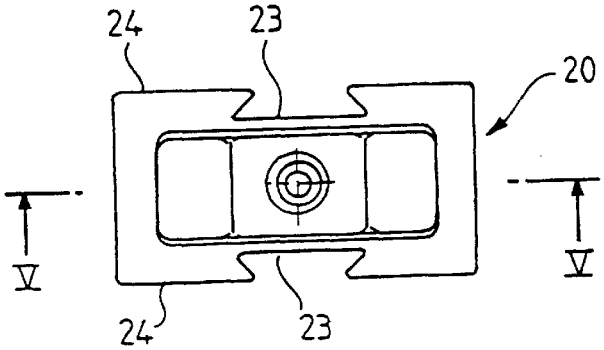
FIG. 4 is a top view according to FIG. 3.
Figure 5:
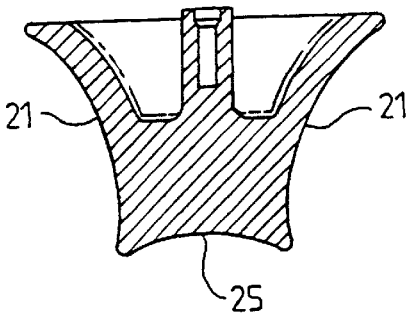
FIG. 5 is a longitudinal cross-sectional view of the element taken along the line V—V of FIG. 4.
Figure 6:
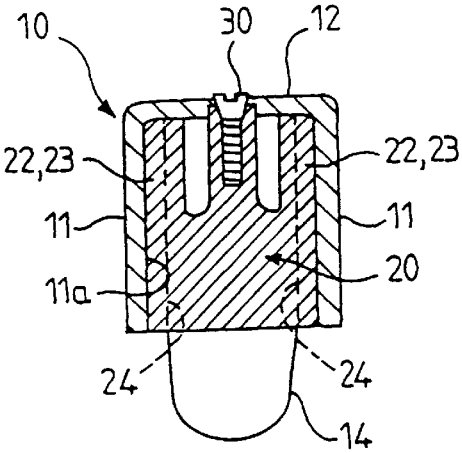
FIG. 6 is a transverse cross-sectional view taken along the line VI—VI of FIG. 3.
Figure 7:
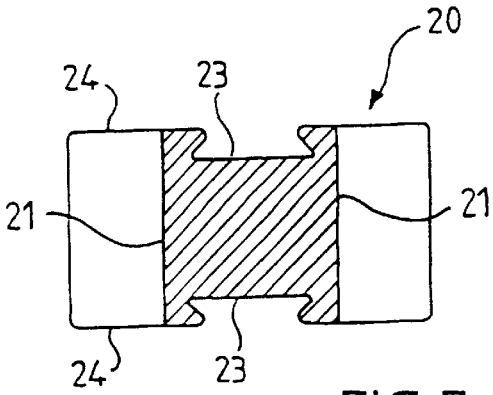
FIG. 7 is a cross-sectional view taken along the line VII—VII of FIG. 3.

FIGS. 1 and 2 show a frame 10 for an in-line roller skate of the traditional type, i.e., with a U-shaped transverse section and having two lateral flanges 11 connected together by one or more horizontal support surfaces 12.

Wheels 14, 15 are mounted in a manner known in itself on the frame 10 by means of axes 13.

The wear element 20 is conventionally mounted on the frame between the two middle wheels 14 and has a substantially parallelepipedical shape, having laterally, in the longitudinal direction, two surfaces 21 in the form of a cylinder portion for the passage of the adjacent wheels 14.

According to the invention, the support and wear element 20 has means for attachment on the frame 10 which are constituted of vertical slide bars 22 facing each other on both sides of the internal surfaces 11*a* of the flanks 11 of the frame and cooperating with corresponding grooves 23 made on two opposite lateral surfaces 24 of the support and wear element 20, such that its sliding mounting onto the flanks 11 simultaneously ensures, on the one hand, its linkage with the flanks and, on the other hand, the linkage of the flanks 11 of the frame 10 to one another in the transverse direction without secondary means, to constitute a single and coherent assembly with the frame 10.

As a result, a linkage of the flanks of the frame to one another is achieved along the whole height of the latter and allows avoiding the phenomena of pulling out the flanges at least in the binding zone.

As shown particularly well in all of the figures, and according to a preferred embodiment example, the slide bars 22 and the grooves 23 of the flanks 11 of the frame 10 and of the element 20, respectively, have complementary dovetail shaped sections.

According to a preferred embodiment, the dovetail shaped sections of at least one element have a decreasing profile in the direction of the lower edge of the frame so as to have a wedging effect between the wear element 20 and the flanks of the frame when it is positioned and to thus eliminate the manufacturing backlash.

According to another interesting feature of the invention, the support and wear element 20 has complementary attachment means constituted of a vertical screw 30 taking support on an upper surface of a horizontal wall 12 of the frame 10 and engaging with the element 20 on which it acts in traction against a lower surface of the wall 12, so as to immobilize it in the vertical direction.

The vertical screw 30 will have an adequate length, predetermined beforehand, so as to ensure an efficient attachment with respect to the frame, while reserving a large heel for the support and wear element 20, in order to offer a maximum of wear material through which the screw 30 does not extend.

According to another feature of the invention, the support and wear element has, at its free end opposite to the attachment screw 30 and adapted to constitute a wear surface, a concave surface 25 having a predetermined radius.

Likewise, the lateral flanks 11 of the frame 10 have, on their free lower edges, concave cutouts 26, arranged to coincide with the concave surface 25 of the element 20.

Numerous variations could be made to the embodiment that has just been mentioned, such as, for example, the support and wear element which could very well have a longitudinal slot arranged in a median manner with respect to its lower surface, so as to provide two support surfaces, as known in the prior art mentioned in the preamble.

The instant application is based upon French patent application No. 97 15122, filed Nov. 26, 1997, the disclosure of which is hereby incorporated by reference thereto in its entirety, and the priority of which is hereby claimed under 35 USC 119.

What is claimed is:

1. A support and wear element for an in-line roller skate frame, adapted to be inserted between two lateral flanks of said frame and between two adjacent middle wheels, for practicing aggressive skating and for ensuring transverse sliding of the skate on a longilinear element wherein said support and wear element comprises a structure to attach said element on the frame; said structure including vertical slide bars, facing each other on both sides of the internal surfaces of the flanks and cooperating with corresponding grooves made on two lateral opposite surfaces of the support and wear element, such that sliding the support and wear element onto said flanks simultaneously ensures a linkage to said flanks and a linkage of the flanks of the frame to one another in the transverse direction, to form a single and coherent assembly with the frame.

2. An element according to claim 1, wherein the slide bars and the grooves of the flanks of the frame and of said element, respectively, have complementary dovetail shaped sections.

3. An element according to claim 1, wherein said element comprises complementary attachment means constituted of a vertical screw taking support on an upper surface of a horizontal wall of the frame and engaging with said element on which it acts in traction against a lower surface of said wall, so as to immobilize it in the vertical direction.

4. An element according to claim 1, wherein said element has, at its free end opposite to the attachment screw and adapted to constitute a wear surface, a concave surface having a predetermined radius.

5. An element according to claim 4, wherein the lateral flanks, of the frame have, on their free lower edges, concave cutouts arranged to coincide with the concave surface of said element.

6. A frame for an in-line roller skate, wherein it integrates a support and wear element according to claim 1.

* * * * *